US007610728B1

(12) United States Patent
Manocchia

(10) Patent No.: US 7,610,728 B1
(45) Date of Patent: Nov. 3, 2009

(54) MOLDED PLASTIC SYSTEM FOR USE IN CONSTRUCTING FOOTINGS OR SUPPORTS FOR STRUCTURES

(76) Inventor: Louis E. Manocchia, 10 Sherman Ave., North Providence, RI (US) 02911

( * ) Notice: Subject to any disclaimer, the term of this patent is extended or adjusted under 35 U.S.C. 154(b) by 0 days.

(21) Appl. No.: 12/123,582

(22) Filed: May 20, 2008

(51) Int. Cl.
*E02D 27/42* (2006.01)
*F16M 13/00* (2006.01)

(52) U.S. Cl. ..... 52/299; 52/298; 248/357; 248/529

(58) Field of Classification Search ..... 52/299, 52/165, 126.6, 126.7, 126.5, 298; 248/357, 248/159, 519, 529; 254/100
See application file for complete search history.

(56) References Cited

U.S. PATENT DOCUMENTS 776,881 A * 12/1904 Ambrose ..... 248/644
866,881 A * 9/1907 Parker ..... 254/98
2,280,220 A * 4/1942 Crosby ..... 52/126.6
2,380,692 A * 7/1945 Gunnison ..... 52/126.6
3,693,310 A 9/1972 Middleton
3,921,356 A * 11/1975 Hughes ..... 52/299
4,263,762 A 4/1981 Reed
4,269,010 A 5/1981 Glass
4,546,581 A * 10/1985 Gustafson ..... 52/169.9
4,575,985 A 3/1986 Eckenrodt
4,648,220 A 3/1987 Gebelius
4,685,258 A * 8/1987 Av-Zuk ..... 52/126.6
4,914,875 A * 4/1990 Gustafson ..... 52/126.6
4,926,785 A * 5/1990 Lamson ..... 116/209
4,972,642 A 11/1990 Strobl, Jr.
4,995,206 A 2/1991 Colonias et al.
5,076,032 A 12/1991 Lehman
5,392,575 A 2/1995 Hoffman et al.
5,412,914 A 5/1995 Daw et al.
5,499,476 A * 3/1996 Adams et al. ..... 52/220.1
5,561,950 A * 10/1996 Collins et al. ..... 52/126.6
5,571,229 A 11/1996 Fitzsimmons et al.
5,586,742 A * 12/1996 Carter ..... 248/545
5,590,494 A * 1/1997 Miller ..... 52/169.9
5,595,039 A 1/1997 Lowery
5,595,366 A * 1/1997 Cusimano et al. ..... 248/354.3
5,603,187 A 2/1997 Merrin et al.
5,611,514 A * 3/1997 Oliver et al. ..... 248/357
5,651,417 A * 7/1997 Coughlin ..... 169/51
5,791,096 A * 8/1998 Chen ..... 52/126.6
6,202,369 B1 * 3/2001 Partee et al. ..... 52/165

(Continued)

*Primary Examiner*—Gay Ann Spahn
(74) *Attorney, Agent, or Firm*—Salter & Michaelson

(57) ABSTRACT

A molded plastic system for use in constructing footings or supports for structures, preferably for supporting a deck. The system includes a base that includes a lower peripheral flange that extends in a substantially horizontal plane in use with the peripheral flange having an upper facing surface and a lower facing surface and an upright post that is integral with the base, extends upwardly from the upper facing surface of the base and is hollow to define a top opening of the base. The system also includes a column that includes top and bottom ends. The bottom end of the column is positioned in the base opening and extends in a generally vertical direction from the base. A cap includes a bottom end having an opening into which the top end of the column is placed for mounting the cap from the column. The cap further includes opposed side tangs that define therebetween an open channel for receiving a support structure.

4 Claims, 4 Drawing Sheets

U.S. PATENT DOCUMENTS 6,206,613 B1 * 3/2001 Elkins ..... 405/157
6,332,292 B1 * 12/2001 Buzon ..... 52/126.6
6,591,570 B2 * 7/2003 Miller, Jr. ..... 52/632
6,620,271 B2 * 9/2003 Mayle et al. ..... 156/73.5
6,955,330 B1 * 10/2005 Weiser et al. ..... 248/529
6,994,099 B2 * 2/2006 Goldwitz ..... 135/122
2002/0148173 A1 * 10/2002 Kugler ..... 52/126.6
2004/0035064 A1 * 2/2004 Kugler et al. ..... 52/126.6
2004/0261329 A1 * 12/2004 Kugler et al. ..... 52/126.6
2006/0258954 A1 * 11/2006 Timberlake et al. ..... 600/564

* cited by examiner

MOLDED PLASTIC SYSTEM FOR USE IN CONSTRUCTING FOOTINGS OR SUPPORTS FOR STRUCTURES

TECHNICAL FIELD

The present invention relates to footings for posts and particularly to molded plastic footing assemblies for use in supporting structures such as decks, sheds, porches, and the like.

BACKGROUND OF THE INVENTION

In the past, footings have generally been constructed of concrete, which is heavy to transport to the site, requires mixing with water, has a long curing time before it can be used, and leaves tools difficult to clean at best or useless at worst. Until now, when a homeowner or contractor wanted to build a deck, shed, porch or other small structure, the preferred way he or she could create a proper footing was to mix concrete (usually by hand in small batches), pour it into a prepared hole, with or without a paper tube placed therein, and wait a day or more for the concrete to set up. This is a tedious and time consuming task which often produces unsatisfactory results. Most applications require multiple footings. Frequently, such applications are in remote areas to which concrete and water have to be carried with no small difficulty. If the footing is set in the wrong place or at the wrong height, it has to be dug out and replaced, resulting in additional expense and loss of time.

Much of the prior art involves the use of concrete with all its disadvantages: U.S. Pat. No. 4,648,220 to Sven R. Gebelius (Mar. 10, 1987); U.S. Pat. No. 4,269,010 to Carl R. Glass (May 26, 1981) U.S. Pat. No. 4,995,206 to Colonias, Lafayette, et als. (Feb. 26, 1991). Some prior art involves complex metal structures: Gebelius, supra, Colonias, supra. Others are not suitable for supporting more than posts for fences, mailboxes, and the like: U.S. Pat. No. 5,076,032 to John F. Lehman (Dec. 31, 1991); Glass, supra. Still others merely sit on the surface of the ground: U.S. Pat. No. 5,392,575 to Hoffman and Bright (Feb. 28, 1995); require that wood or other structural materials be installed below ground: U.S. Pat. No. 4,972,642 to Frederick P. Strobl, Jr. (Nov. 27, 1990); or are more suitable to the construction of larger buildings: U.S. Pat. No. 4,263,762 to Stanley D. Reed (Apr. 28, 1981).

Accordingly, it is an object of the present invention to provide an improved system for constructing footings.

Another object of the present invention is to provide an improved system for constructing footings in which the use of concrete is no necessary for establishing the footing.

Still another object of the present invention is to provide an improved footing system for support structures that is easy to use and relatively simple to construct in place.

According, several objects and advantages of the present invention are its ease of transport to the place of use, clean and simple installation, availability for immediate use, consistency of strength, and imperviousness to degradation.

Still a further object of the present invention is to provide an improved system for constructing a footing that is preferably of a hard plastic material and that is constructed so as to be maintained in place once erected.

SUMMARY OF THE INVENTION

In accordance with the present invention there is provided a molded plastic system for use in constructing footings or supports for structures, preferably for supporting a deck. The molded plastic system comprises a base that includes a lower peripheral flange that extends in a substantially horizontal plane in use; the peripheral flange having an upper facing surface and a lower facing surface; the base further including an upright post that is integral with the base, extends upwardly from the upper facing surface of the base and is hollow to define a top opening of the base; a column that includes top and bottom ends; the bottom end of the column being positioned in the base opening and extending in a generally vertical direction from the base and a cap that includes a bottom end having an opening into which the top end of the column is placed for mounting the cap from the column; the cap further including opposed side tangs that define therebetween an open channel for receiving a support structure.

The present invention includes also the following aspects wherein the base flange is circular and the column is in the form of a plastic tube or pipe; the lower facing surface of the base has ridges that assist in the securing of the base in a ground material; the ridges include spaced ridges that are disposed in parallel to each other; including spaced ridges that are disposed in a grid pattern; the grid pattern is formed by two sets of spacedly disposed ridges that respectively extend at a right angle to each other; including a plurality of support ribs that each extend between the upper facing surface of the base and an outer surface of the column; the column comprises a hollow plastic pipe, each of the support ribs are substantially triangular in shape and each of the support ribs have respective sides that are integrally formed with the upper facing surface of the base and the outer surface of the hollow plastic pipe; the plurality of support ribs are spacedly disposed about the hollow plastic pipe and provide a reinforcement for the hollow plastic pipe; the cap is cylindrical and the tangs each include a flat inner surface that defines the open channel of the cap and a curved outer surface that is contiguous with the cylindrical outer surface of the cap; each tang has an aperture extending therethrough for receiving a fastening means for securing the support structure to the cap and each aperture has an indented stepped section of a diameter greater than the diameter of the aperture.

BRIEF DESCRIPTION OF THE DRAWINGS

Numerous other objects, features and advantages of the present invention will now become apparent upon the reading of the following detailed description as taken in conjunction with the accompanying drawings, in which.

DETAILED DESCRIPTION

Figure 1:
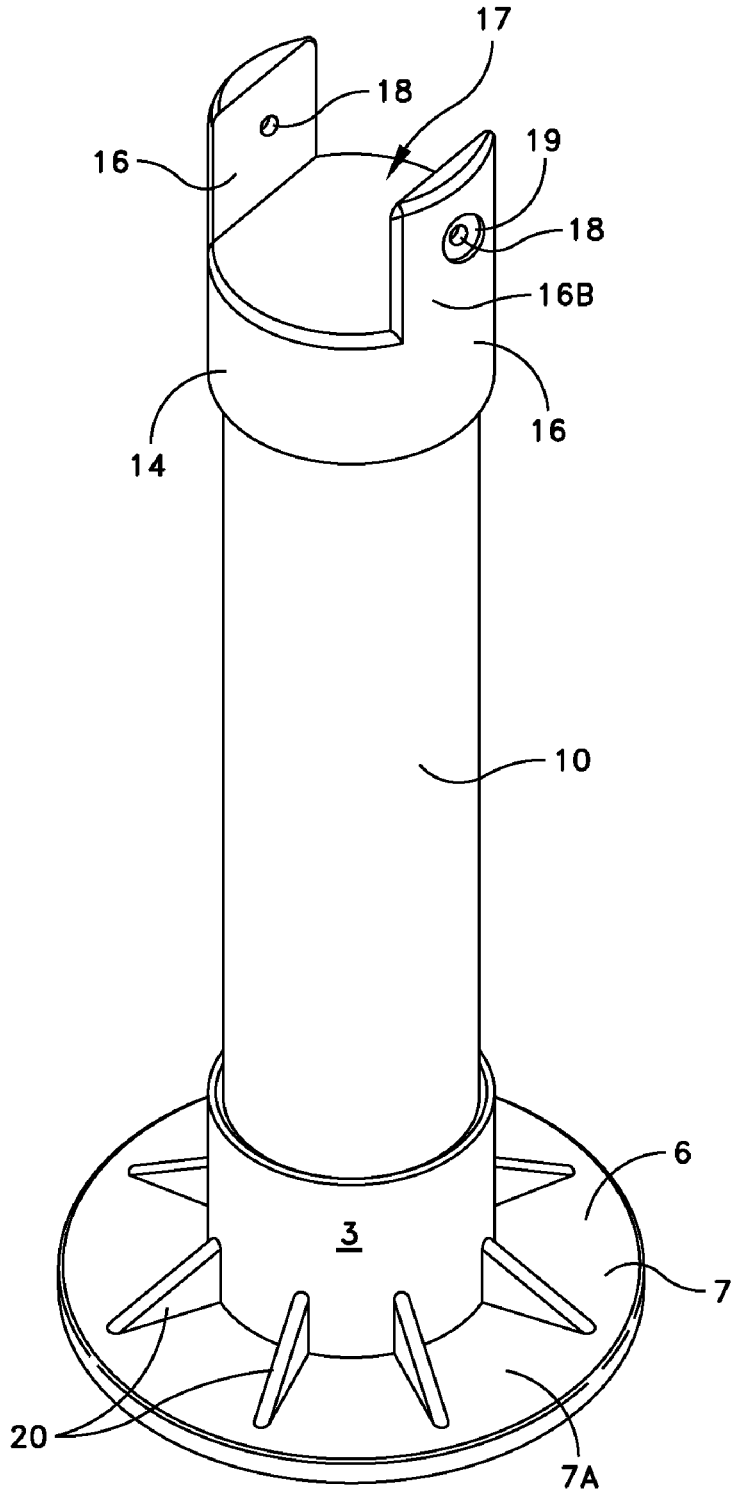
FIG. 1 is a perspective view of the improved footing of the present invention.

The present invention relates to footings for posts and particularly to molded plastic footing assemblies for use in supporting decks, sheds, porches and the like. It is applicable to all locales, including those having frost-penetrable soil and a surface exposed to the possibility of below freezing temperatures. These footings are generally placed in holes excavated in the ground to a depth appropriate for ambient soil and temperature conditions. The present invention is a device comprised of a prefabricated supporting base, column and cap with tangs for providing support for structures such as decks, porches, sheds, etc. The present invention provides a convenient, economical and time and labor saving alternative to traditional footings.

The invention is comprised of a molded plastic base 6 set into a hole which has been dug at the desired location. The first step in installing the invention involves securing to the base a column 10, usually made of plastic, such as polyvinyl chloride pipe commonly available, but which may be of any material of suitable strength. The column 10 is of a height appropriate to the application (to account for frost, elevation, or other conditions), and is preferably secured to the base 6 by applying waterproof adhesive thereto. The base 6 is wider than the column 10 and has a substantially flat bottom flange 7. The assembly is then placed in the prepared hole. In the preferred embodiment, and depending on the material used in its manufacture, said base assembly has structural ribs 20. A cap 14 with tangs 16 attached into which holes 18 are predrilled is secured in place on top of the column 10 by inserting the column 10 into the opening 12 in the bottom of said cap. The cap 14 is installed in the proper orientation to receive a post or beam (not shown) usually made of pressure-treated wood, which is part of the structure to be built. The assembly is placed into a prepared hole and backfilled so that only the cap and the top portion of the column are above grade.

Figure 2:
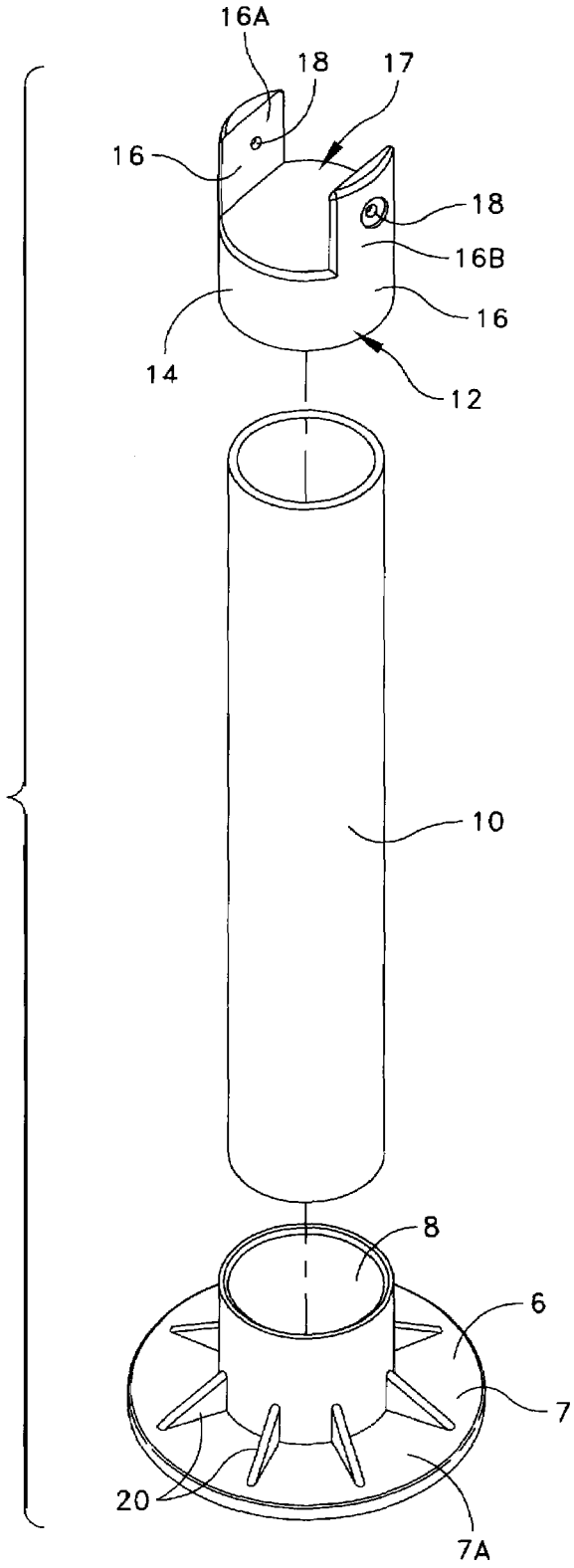
FIG. 2 is a perspective view similar to that shown in FIG. 1 with the components exploded away from each other.
Figure 3:
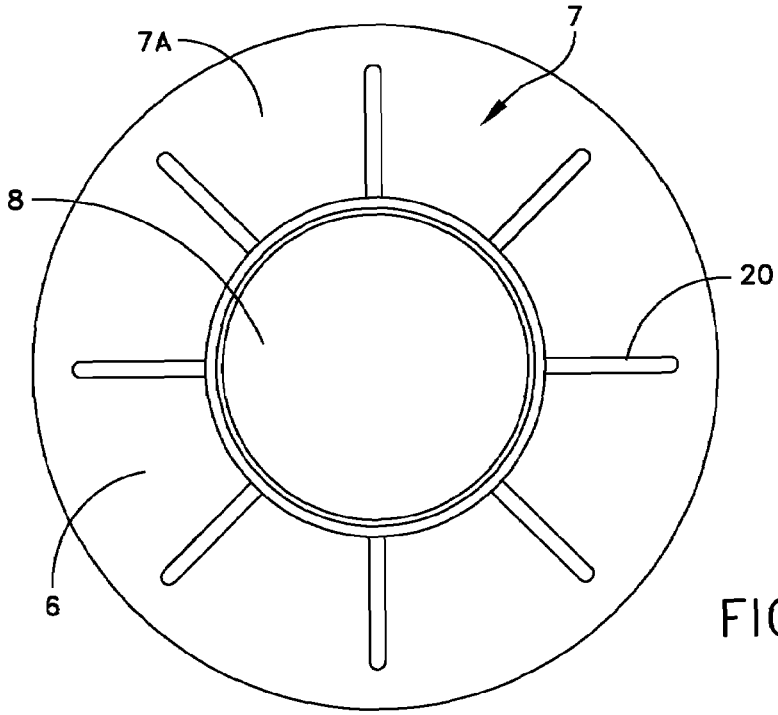
FIG. 3 is a plan view of the base.
Figure 4:
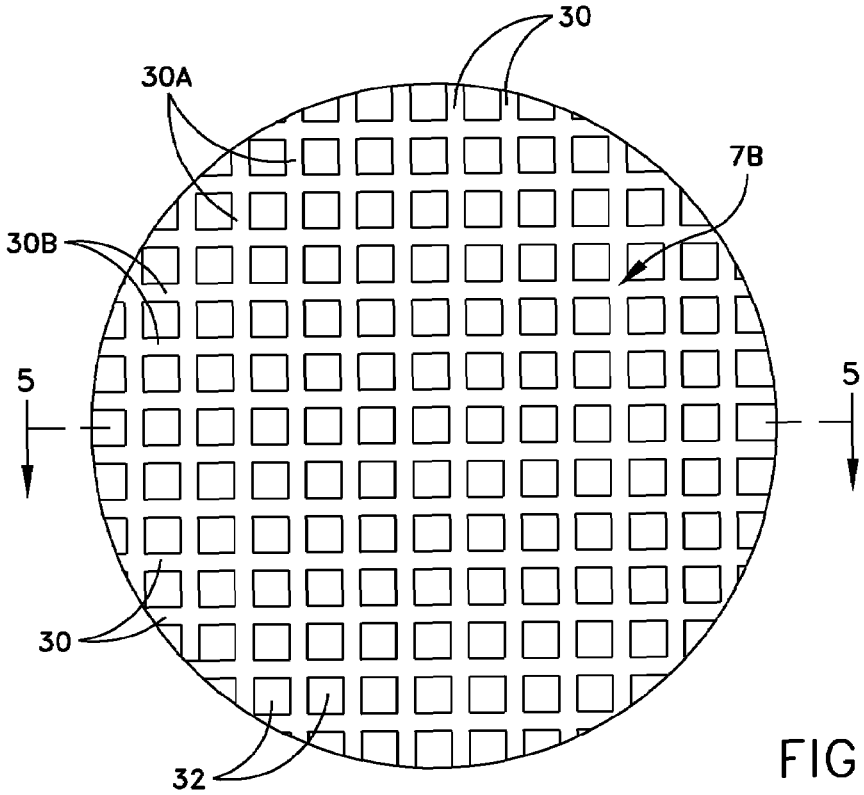
FIG. 4 is a bottom view of the base.
Figure 5:
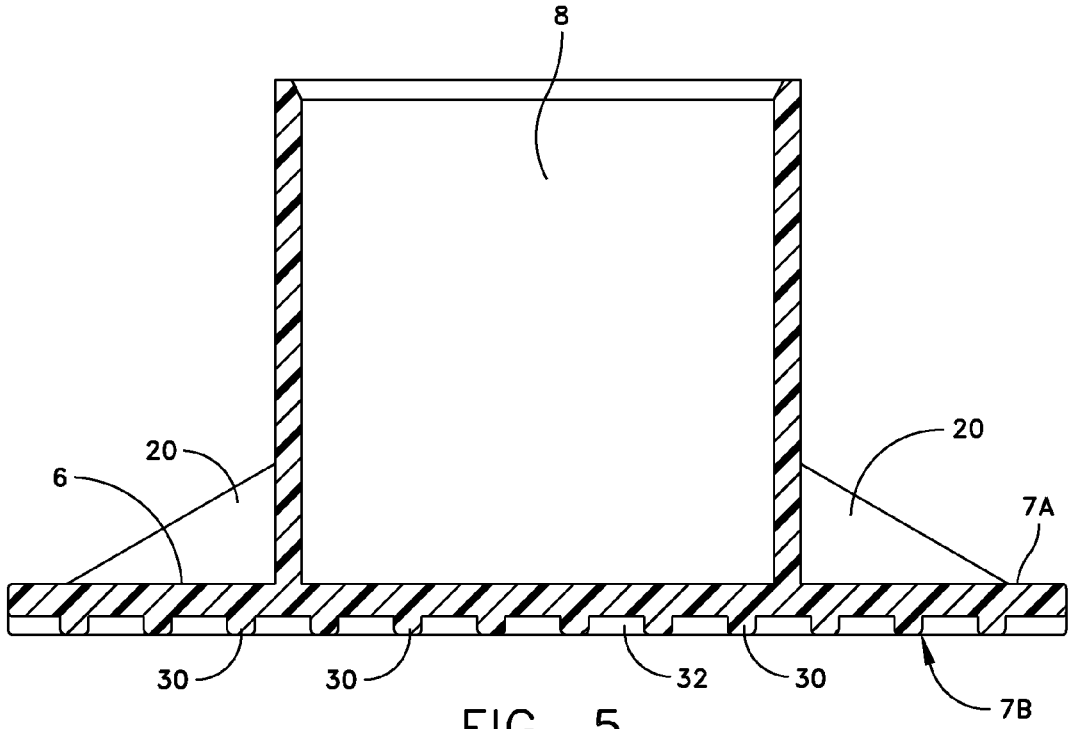
FIG. 5 is a cross-sectional view taken along line 5-5 of FIG. 4.

As indicated before there is provided a molded plastic system for use in constructing footings or supports for structures, preferably for supporting a deck. The system shown in FIGS. 1-6 includes a base 6 that includes a lower peripheral flange 7 that extends in a substantially horizontal plane in use. The peripheral flange 7 has an upper facing surface 7A and a lower facing surface 7B. The base 6 further includes an upright post 3 that is integral with the base 7, extends upwardly from the upper facing surface 7A of the base 6 and is hollow to define a top opening 8 of the base. The post 3 is preferably hollow from the flange 7 up. The system also includes a column 10 that includes top and bottom ends, the bottom end of the column 10 being positioned in the base opening and extending in a generally vertical direction from the base, as depicted in FIGS. 1 and 2. A cap 14 includes a bottom end having an opening into which the top end of the column 10 is placed for mounting the cap 14 from the column 10. The cap 10 further includes opposed side tangs 16 that define therebetween an open channel 17 for receiving a support structure, such as a beam or any other type of construction piece. The cap 14 may also be fixed with the column 10 by the application of an adhesive between these components. The cap 14 is hollow to receive the top of the column 10 and includes a wall that defines the bottom of the channel 17.

Figure 6:
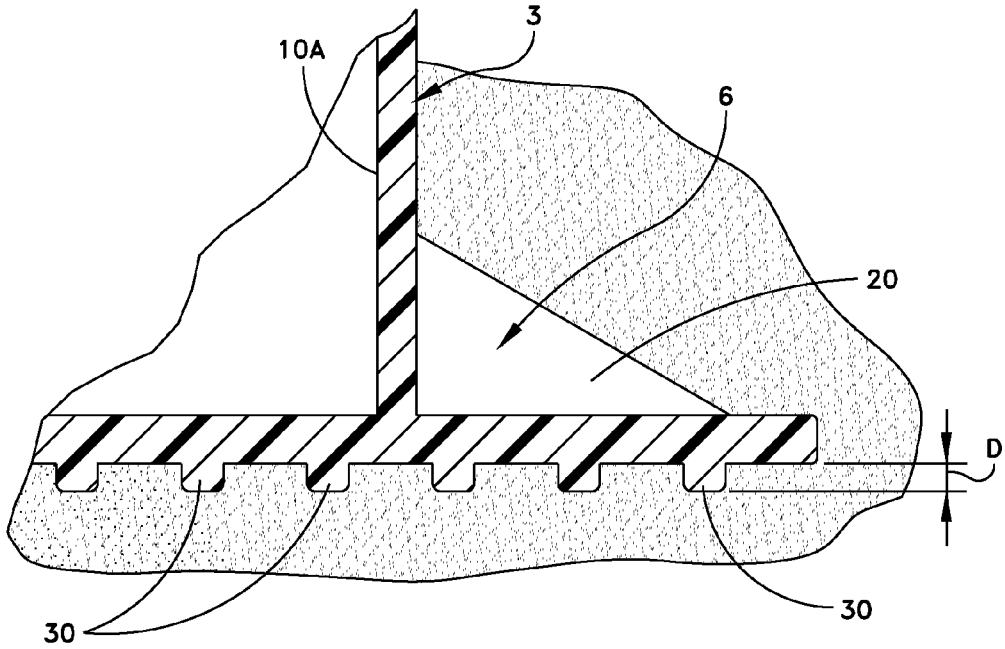
FIG. 6 is a fragmentary cross-sectional view illustrating the portion of the base with surrounding ground material.

The base flange 7 is preferably circular, such as a PVC pipe that is well known. The lower facing surface 7B of the base preferably has ridges 30 that assist in the securing of the base in a ground material. It has been found that the construction footing in accordance with the present invention is more stable by providing the illustrated ridge arrangement, particularly as depicted in the pattern shown in FIG. 4. The ridges 30 include spaced ridges that are disposed in parallel to each other in transverse rows 30A and 30B. As illustrated in, for example, FIG. 4 the spaced ridges are disposed in a right angle grid pattern. The grid pattern is formed by two sets of spacedly disposed ridges 30A and 30B that respectively extend at a right angle to each other. There are preferably anywhere between 5 and 20 ridges in each set. Each of the ridges 30 preferably has the same depth, and the depth D, as shown in FIG. 6, is on the order of one-eighth to one-half inch. The width of each ridge 30 is preferably smaller than the distance between ridges. This transverse ridge pattern provides an array of pockets 32 that are filled with earth as shown in FIG. 6. This provides a firm engagement between the base 6 and the surrounding earth material.

The molded plastic system, particularly the base 6, further includes a plurality of support ribs 20 that each extend between the upper facing surface 7A of the base 6 and an outer surface 10A of the column 10. The column 10 preferably comprises a hollow plastic pipe, each of the support ribs 20 are substantially triangular in shape and each of the support ribs 20 have respective sides that are integrally formed with the upper facing surface 7A of the base and the outer surface 10A of the hollow plastic pipe. The plurality of support ribs 20 is spacedly disposed about the hollow plastic pipe, and about a circular locus of the column 10. There are preferably anywhere between 6 and 10 spacedly disposed ribs 20.

In the molded plastic system the cap 14 is preferably cylindrical and the tangs 16 each include a flat inner surface 16A that defines the open channel 17 of the cap and a curved outer surface 16B that is contiguous with the cylindrical outer surface of the cap 14. Each tang preferably has an aperture 18 extending therethrough for receiving a fastening means for securing the support structure to the cap. Each aperture 18 also preferably has an indented stepped section 19 of a diameter greater than the diameter of the aperture or hole 18.

Accordingly, it can be seen that the present invention is superior to prior art in that its installation is cleaner and simpler and that construction of the structure can begin without the delay normally associated with waiting for concrete installations to dry and cure. Also, once installed, the assembly is resistant to frost heaving, uploads and lateral movement. Contractors and homeowners alike will appreciate the relative convenience and ease of installation of the invention over existing methods and products.

The description above contains many specificities, these should not be construed as limiting the scope of the invention but as merely providing illustrations of some of the presently preferred embodiments of this invention. Various other embodiments and ramifications are possible within its scope. For example, the configuration of the base may be altered depending on the materials used in its manufacture. Thus the scope of the invention should be determined by the appended claims and their legal equivalents, rather than by the examples given.

The invention claimed is:

1. A molded plastic system for use in constructing footings or supports for structures, preferably for supporting a deck, said system comprising:

a base that includes a lower peripheral flange that extends in a substantially horizontal plane in use;

the peripheral flange having an upper facing surface and a lower facing surface;

the base further including an upright cylindrical post that is integral with the peripheral flange, extends upwardly from the upper facing surface of the peripheral flange and is hollow to define a top cylindrical opening of the upright cylindrical post;

a column that includes top and bottom ends;

the bottom end of the column being positioned in the opening of the post of the base and the column extending in a generally vertical direction from the base; and a cap that includes a bottom end having an opening into which the top end of the column is placed for mounting the cap around an outer surface of the top end of the column;

the cap further including opposed side tangs that define therebetween an open channel for receiving a support structure;

said lower peripheral flange of the base being circular and having a thickness that is substantially less than a diameter of the peripheral flange;

said column is in the form of a plastic tube or pipe and being cylindrical;

an outer diameter of the column being less than an inner diameter of the cylindrical opening of the post of the base so that the bottom end of the column fits in the opening of the post of the base;

the lower facing surface of the peripheral flange having ridges that assist in the securing of the base in a ground material;

the ridges extending downwardly from the lower facing surface of the peripheral flange;

the ridges being spaced ridges that are disposed in respective orthogonal ridge sets so as to form a right angle grid pattern that includes multiple sets in orthogonal directions;

the width of each ridge being less than the spacing between the ridges;

said base further including a plurality of support ribs that each extend between the upper facing surface of the flange and an outer surface of the post of the base;

each of the support ribs being of substantially triangular shape and each of the support ribs have respective sides that are integrally formed with the upper facing surface of the flange and an outer surface of the post of the base;

the plurality of support ribs being spacedly disposed about the post of the base to provide a reinforcement for the post of the base;

said cap also being cylindrical and the tangs each including a flat inner surface that defines the open channel of the cap, that has a width less than an outer diameter of the cap, that has a channel depth measured along a vertical longitudinal axis of the cap and that has a curved outer surface that is contiguous with the cylindrical outer surface of the cap;

both said tangs having an aperture extending therethrough for receiving a fastening means for securing the support structure in the channel between the tangs;

each said aperture in the tang extending therethrough in a direction that is orthogonal to the vertical longitudinal axis of the channel of the cap so that the fastening means extend in the same direction into the support structure on opposite sides thereof.

2. The molded plastic system of claim 1 wherein the apertures in the tangs are in a substantially straight alignment with each other.

3. The molded plastic system of claim 1 wherein each support rib extends along the outer surface of the post of the base a distance less than half the height of the post of the base.

4. The molded plastic system of claim 1 wherein each aperture has an indented stepped section of a diameter greater than the diameter of the aperture.

* * * * *